US009573399B2

(12) United States Patent
Suzuki et al.

(10) Patent No.: US 9,573,399 B2
(45) Date of Patent: Feb. 21, 2017

(54) AIR JET EMISSION METHOD USED IN LIQUID EJECTING APPARATUS, AND THE APPARATUS

(71) Applicant: SEIKO EPSON CORPORATION, Tokyo (JP)

(72) Inventors: Shigeki Suzuki, Shiojiri (JP); Toshinobu Yamazaki, Niigata (JP); Masahiko Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/078,619

(22) Filed: Mar. 23, 2016

(65) Prior Publication Data

US 2016/0288536 A1 Oct. 6, 2016

(30) Foreign Application Priority Data

Apr. 6, 2015 (JP) ..... 2015-077972

(51) Int. Cl.
*B41J 29/17* (2006.01)
*B41J 11/00* (2006.01)
*B41J 2/165* (2006.01)

(52) U.S. Cl.
CPC ..... *B41J 29/17* (2013.01); *B41J 11/002* (2013.01); *B41J 2002/16555* (2013.01)

(58) Field of Classification Search
CPC ..... B41J 2/165; B41J 2/16552; B41J 2/1714; B41J 2/04566; B41J 11/0005; B41J 2/16505; B41J 2002/16555; B41J 2/16579; B41J 2002/16502
See application file for complete search history.

(56) References Cited

U.S. PATENT DOCUMENTS 6,390,618 B1 * 5/2002 Wotton ..... B41J 11/002 347/102

FOREIGN PATENT DOCUMENTS

JP 2003-220695 8/2013

* cited by examiner

*Primary Examiner* — Thinh H Nguyen
(74) *Attorney, Agent, or Firm* — Workman Nydegger

(57) ABSTRACT

Provided is an air jet emission method used in a recording apparatus. The recording apparatus performs predetermined printing by ejecting ink droplets from a recording head provided in an apparatus body onto a medium. The medium is fed into the apparatus body while being guided by a guide and is transported from an upstream side, which is one side with respect to the apparatus body, toward a downstream side, which is an opposite side with respect to the apparatus body. The air jet emission method comprises: emitting a jet of air onto a surface of the transported medium at a predetermined area over a heating device at the upstream side, thereby blowing dust off the surface of the transported medium. The heating device is provided in the guide so as to apply heat to the transported medium.

8 Claims, 2 Drawing Sheets

AIR JET EMISSION METHOD USED IN LIQUID EJECTING APPARATUS, AND THE APPARATUS

The entire disclosure of Japanese Patent Application No: 2015-077972, filed Apr. 6, 2015 is expressly incorporated by reference herein in its entirety.

BACKGROUND

1. Technical Field

The present invention relates to a method for emitting a jet of air in a liquid ejecting apparatus, and the apparatus. More particularly, the invention relates to an air jet emission technique that is useful when applied to a large format printer.

2. Related Art

A liquid ejecting apparatus is provided with a liquid ejecting head and performs predetermined printing by emitting liquid droplets from the liquid ejecting head onto a medium such as paper, cloth, a film, or the like. A typical example of such a liquid ejecting apparatus is an ink-jet recording apparatus (hereinafter may be simply referred to as "recording apparatus"), which is provided with an ink-jet recording head (hereinafter may be simply referred to as "recording head") for ejecting ink droplets. A so-called large format printer, which is a kind of such a recording apparatus, performs printing on large-sized paper. The body of such a large format printer is mounted on its stand. In such a large format printer, a medium is transported along a guide and is fed into the printer body while being guided by the guide through an opening formed at an upstream side, which is the entrance side of the printer body, and, after completion of predetermined printing by a recording head inside the printer body, is outputted through an opening formed at a downstream side, which is the exit side of the printer body. The medium is in the form of a roll and is rotatably supported by the stand. The medium is unreeled and is fed into the printer body from the upstream side. As mentioned above, the recording head performs predetermined printing, and, after that, the medium is outputted from the exit side of the printer body.

In such a large format printer, the transportation path of the medium supported in the form of a roll by the stand and transported along the guide before being fed into the printer body at the upstream side as viewed from the recording head is long. Because of the long transportation path, the probability of settlement of dust (fiber particles, etc.) drifting in the air onto the surface of the unreeled medium is high. If printing is performed on such a medium the surface of which is contaminated with dust, it causes displacement in the landing positions of ink droplets ejected, resulting in poor print quality.

A known technique for preventing the nozzles of the recording head of an ink-jet recording apparatus from being clogged with paper dust or other dust and thereby guaranteeing great reliability is disclosed in JP-A-2003-220695. In the structure disclosed in JP-A-2003-220695, an air stream is produced inside the body of the apparatus at an upstream side as viewed from the recording head so as to prevent dust, etc. from entering the body of the apparatus. In this structure, a voltage is applied between a transportation unit and the recording head to apply electric charges to dust, etc. drifting in the air, thereby causing the dust, etc. to be attracted onto a medium by static electricity.

However, in JP-A-2003-220695, there is a possibility that the air stream produced at the upstream side as viewed from the recording head will cause displacement in the landing positions of ink droplets ejected. Moreover, when the charged dust is attracted onto the medium, depending on the attitude of the dust such as fiber particles, etc., there is a risk of the re-settlement of the dust into the nozzles of the recording head and the resultant running of ink droplets down onto the medium via the fiber particles. In both of these cases, print quality will be poor.

The problems described above are not unique to an ink-jet recording apparatus. The same problems could also arise in various kinds of liquid ejecting apparatuses.

SUMMARY

An advantage of some aspects of the invention is to provide an air jet emission method used in a liquid ejecting apparatus that can effectively blow dust off the surface of a medium before the execution of predetermined printing on the medium by a recording head, and to provide the liquid ejecting apparatus.

An air jet emission method according to one aspect of the invention is: a method used in a liquid ejecting apparatus that performs predetermined printing by ejecting liquid droplets from a liquid ejecting head provided in an apparatus body onto a medium, the medium being fed into the apparatus body while being guided by a guide, the medium being transported from an upstream side, which is one side with respect to the apparatus body, toward a downstream side, which is an opposite side with respect to the apparatus body, comprising: emitting a jet of air or gas onto a surface of the transported medium at a predetermined area including a region of contact with a heater, thereby blowing dust off the surface of the transported medium, the heater being provided in the guide so as to apply heat to the transported medium, the heater being made of a conductive material.

In the above aspect of the invention, it is possible to effectively blow dust off the surface of the medium transported over the transportation path because the air or the gas is blown to the medium at the predetermined area mentioned above.

A more detailed explanation of the virtue of the above aspect is given below. When the medium, which is initially in the form of a roll, is unreeled, it is electrified (unreeling electrification). In addition, the medium is electrified because of friction on the transportation path during transportation (frictional electrification). When the medium in an electrified state arrives at the area of the heater made of a conductive material, apparent voltage level on the surface of the medium becomes 0 V. This is because electric charges having accumulated due to unreeling electrification and frictional electrification escape via the heater made of a conductive material (metal). Therefore, the medium in such a charge-released state has weakened attraction for dust. For this reason, when the air or the gas is blown to this region (the predetermined area mentioned above), it is possible to effectively remove dust by taking advantage of the weakened attraction region, that is, the low voltage region of the medium that was electrified due to unreeling electrification, etc.

A liquid ejecting apparatus according to another aspect of the invention comprises: a medium that is transported along a guide and is fed into an apparatus body while being guided by the guide through an opening formed at an upstream side, which is one side with respect to the apparatus body, and is outputted through an opening formed at a downstream side, which is an opposite side with respect to the apparatus body; a liquid ejecting head that performs predetermined printing by ejecting liquid droplets onto the medium; a heater that is provided in the guide and provided upstream of the liquid ejecting head, is made of a conductive material, and applies heat to the medium; and a blower that emits a jet of air or gas through a nozzle opening to, over the heater at the upstream side, a predetermined area of the medium fed into the apparatus body, thereby blowing dust off the area.

In the above aspect of the invention, it is possible to effectively blow dust off the surface of the medium transported over the transportation path because the air or the gas is blown to the medium by the blower at the predetermined area mentioned above.

A more detailed explanation of the virtue of the above aspect is given below. When the medium, which is initially in the form of a roll, is unreeled, it is electrified (unreeling electrification). In addition, the medium is electrified because of friction on the transportation path during transportation (frictional electrification). When the medium in an electrified state arrives at the area of the heater made of a conductive material, apparent voltage level on the surface of the medium becomes 0 V. This is because electric charges having accumulated due to unreeling electrification and frictional electrification escape via the heater made of a conductive material (metal). Therefore, the medium in such a charge-released state has weakened attraction for dust. For this reason, when the air or the gas is blown to this region (the predetermined area mentioned above), it is possible to effectively remove dust by taking advantage of the weakened attraction region, that is, the low voltage region of the medium that was electrified due to unreeling electrification, etc.

Preferably, the blower should be configured in such a way that the air or the gas having been blown to the surface of the medium through the nozzle opening will go in a direction away from the apparatus body. The reason is as follows. With this preferred structure, since the air or the gas having been blown to the surface of the medium goes in a direction away from the apparatus body, it is possible to prevent the dust having been blown off from drifting toward the apparatus body. Consequently, it is possible to prevent the settlement of the dust on the nozzle surface of the recording head and to therefore keep excellent print quality.

Preferably, the angle formed by a direction in which the jet of the air or the gas is emitted through the nozzle opening and the slope of the surface area of the medium exposed to the jet of the air or the gas emitted should be an acute angle. This is because, with this preferred structure, it is possible to ensure that the air or the gas having been blown to the surface of the medium will go in a direction away from the apparatus body.

Preferably, the nozzle opening should be formed at the tip of a linear portion that is formed by linearly reducing the depth of the duct of the blower; and the nozzle opening should be elongated in a direction orthogonal to the transportation direction of the medium. This is because, with this preferred structure, it is possible to evenly apply the jet of the air or the gas emitted through the nozzle opening to the medium's area extending in the direction (width direction) orthogonal to the transportation direction of the medium.

Preferably, the air inlet of the blower should be located above the nozzle opening, and the air or the gas should be supplied from the upstream side as viewed from the nozzle opening by being taken in a direction that is orthogonal to a direction in which the jet of the air or the gas is emitted through the nozzle opening. Since the air inlet is located above the nozzle opening, this preferred structure reduces the possibility of taking in dust having been blown off as a result of jet emission and drifting therearound through the air inlet. The air or the gas is taken in not at the apparatus-body side but at the opposite side with respect to the jet emission surface in the direction orthogonal to the jet emission direction, that is, the direction in which the jet of the air or the gas is emitted through the nozzle opening. Therefore, this preferred structure further reduces the possibility of taking in dust drifting in air.

The operation of each component provided inside the apparatus body may be controlled by an external controller provided outside the apparatus body. This is because, even if the apparatus body is not provided with any built-in controller, it is possible to supply a drive signal for driving the recording head, etc. remotely thereto from an external independent PC (personal computer), etc. for predetermined printing.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the accompanying drawings, an exemplary embodiment of the present invention will now be explained.

Figure 1:
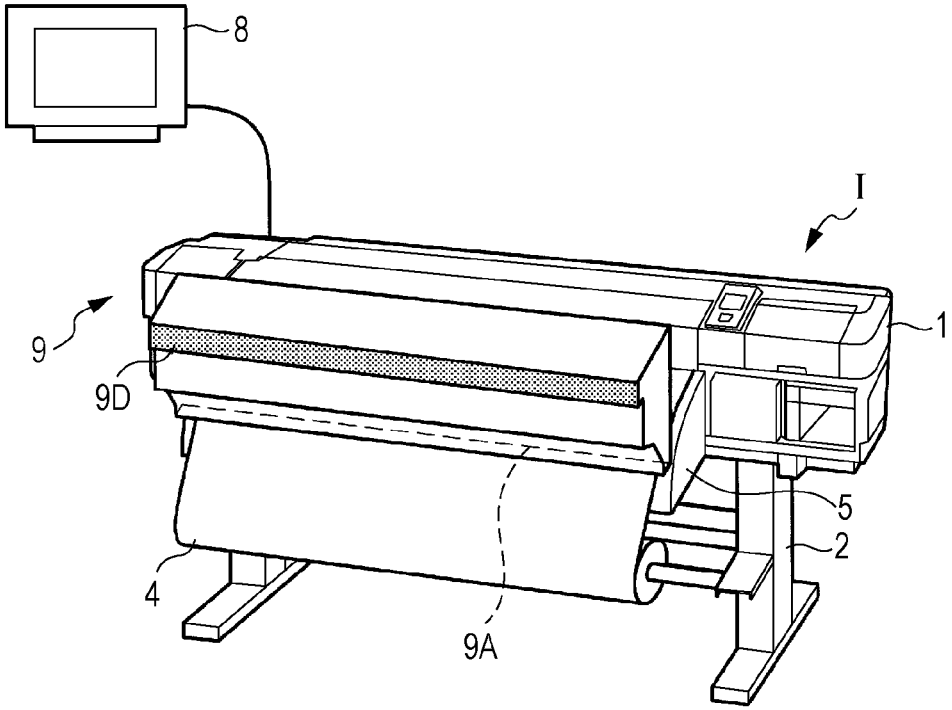
FIG. 1 is a schematic view of the overall structure of an ink-jet recording apparatus according to an exemplary embodiment of the invention.
Figure 2:
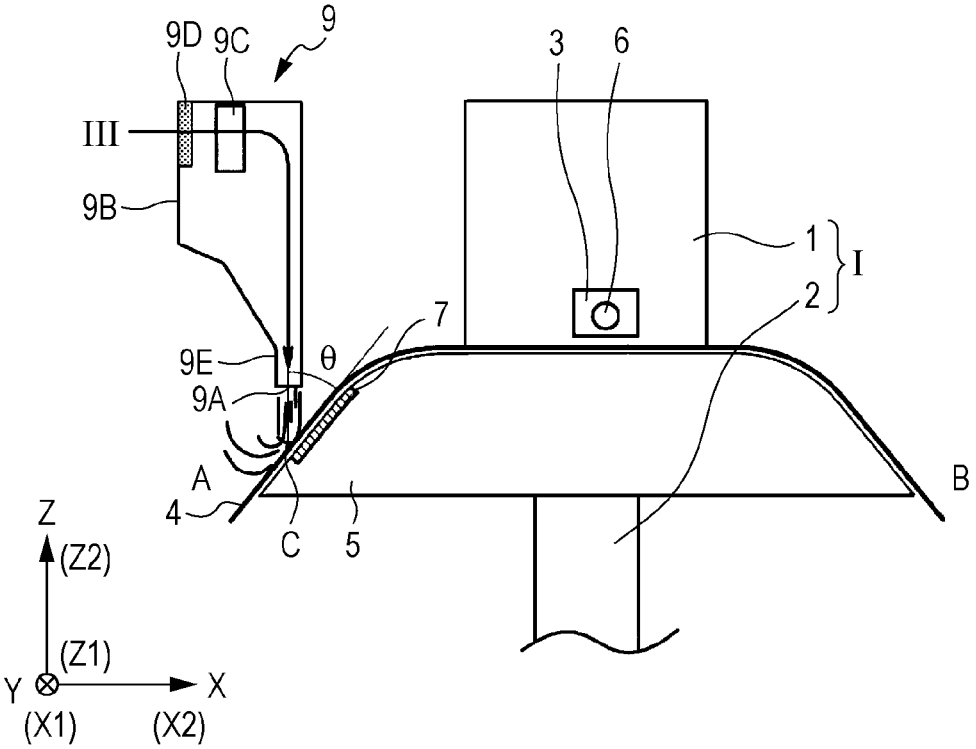
FIG. 2 is a partial enlarged side view showing an essential part of the ink-jet recording apparatus in cross section laterally.

FIG. 1 is a schematic view of the overall structure of an ink-jet recording apparatus according to an exemplary embodiment of the invention. FIG. 2 is a partial enlarged side view showing an essential part of the ink-jet recording apparatus in cross section laterally. An ink-jet recording apparatus according to the present embodiment (hereinafter may be simply referred to as "recording apparatus") I is a large format printer that has the structure illustrated in FIGS. 1 and 2. An ink-jet recording head (hereinafter may be simply referred to as "recording head") 3 is built in the body 1 of the recording apparatus I (apparatus body). The apparatus body 1 is mounted on a stand 2. A medium 4, which is in the form of a roll, is supported by the stand 2. The recording apparatus I includes the medium 4, which is supported in the form of a roll by the stand 2 as mentioned above, the recording head 3, which performs predetermined printing by ejecting ink droplets onto the medium 4, and a guide 5, along which the medium 4 is transported. The medium 4 is transported while being guided by the guide 5, and is fed to the inside of the apparatus body 1 through an opening formed at one side with respect to the apparatus body 1, specifically, an upstream side A, and is outputted through an opening formed at the other side with respect to the apparatus body 1, specifically, a downstream side B. The medium 4, which is initially in a state of being wrapped on the medium shaft supported by the stand 2, is unreeled, and is transported inside the apparatus body 1 from the upstream side A toward the downstream side B. During the transportation inside the apparatus body 1, predetermined printing is performed on the medium 4 by the recording head 3. After the printing, the medium 4 is taken up onto a reel (not illustrated in the drawing). The recording head 3 performs the predetermined printing on the medium 4 while moving along a guide shaft 6 in a direction (Y-axis direction illustrated in FIG. 2) orthogonal to the transportation direction of the medium 4 (X-axis direction from X1 toward X2 in FIG. 2).

A heating device 7, which is an example of a heater made of a conductive material (metal), is embedded in the guide 5 at the upstream side A as viewed from the recording head 3. Prior to printing performed by the recording head 3, the heating device 7 applies heat to the medium 4.

A controlling device 8 according to the present embodiment is an external personal computer (PC). The controlling device 8 generates and outputs various control signals, etc. for causing the components of the recording apparatus I to operate as instructed, for example, a drive signal for driving the recording head 3. Because of this structure, even if the apparatus body 1 is not provided with any built-in controlling device, it is possible to supply a drive signal for driving the recording head 3, etc. remotely thereto for predetermined printing. Needless to say, the controlling means may be built in the apparatus body 1.

In the recording apparatus I according to the present embodiment, a blowing device 9 is provided adjacent to the apparatus body 1 at the upstream side A as viewed from the apparatus body 1. The blowing device 9 emits a jet of air through its nozzle opening 9A to, over the heating device 7 at the upstream side A, a predetermined area C of the medium 4 fed into the apparatus body 1, thereby blowing the dust off the area C. More specifically, as illustrated in FIG. 2, a fan 9C, which is provided inside a duct 9B, operates to take in air through an air inlet 9D. The air flows in the course indicated by the arrow III in FIG. 2 to be emitted as an air stream through the nozzle opening 9A.

The blowing device 9 according to the present embodiment is configured in such a way that the air having been blown to the surface of the medium 4 through the nozzle opening 9A will go in a direction away from the apparatus body 1, that is, toward the upstream side A. More specifically, in the present embodiment, the angle θ formed by the direction in which the jet of air is emitted through the nozzle opening 9A (Z-axis direction from Z2 toward Z1 in FIG. 2) and the slope of the surface area of the medium 4 exposed to the jet of air emitted (area C), is an acute angle. Because of this structure, the air having been blown to the surface of the medium 4 goes toward the upstream side A, that is, in a direction away from the apparatus body 1. Therefore, it is possible to prevent the dust having been blown off from drifting toward the apparatus body 1.

Figure 3:
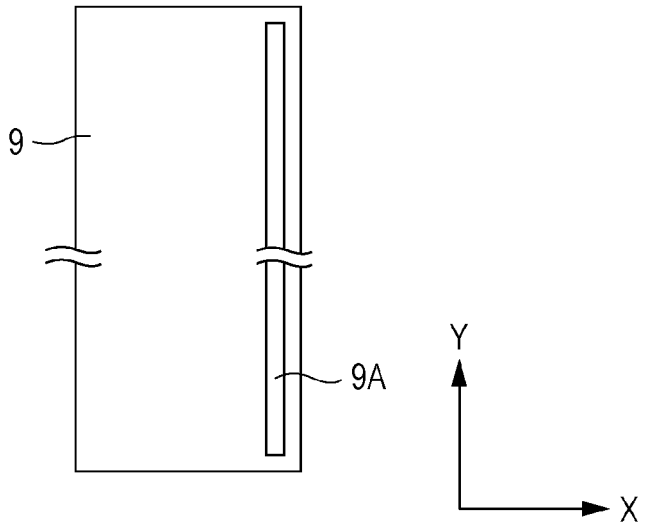
FIG. 3 is a diagram for explaining a nozzle opening viewed from a jet-emission-surface side.

The nozzle opening 9A is formed at the tip of a linear portion 9E, which is formed by linearly reducing the X depth of the duct 9B. As illustrated in FIG. 3, which is a bottom view taken from below the nozzle opening 9A (from Z1) in the vertical direction (Z-axis direction in FIG. 2), the nozzle opening 9A is elongated in the direction (Y-axis direction) orthogonal to the transportation direction of the medium 4 (X-axis direction from X1 toward X2). Because of this structure, it is possible to evenly apply the jet of air emitted through the nozzle opening 9A to the medium's area C extending in the Y-axis direction.

In the present embodiment, the air inlet 9D is located above the nozzle opening 9A in the Z-axis direction (at the Z2 side), and air is supplied from the upstream side A as viewed from the nozzle opening 9A by being taken in the X-axis direction, which is orthogonal to the direction in which the jet of air is emitted through the nozzle opening 9A. That is, as indicated by the arrow III, at the position above the nozzle opening 9A illustrated in FIG. 2 in the Z-axis direction (at the Z2-side position), air flowing horizontally (from X1 to X2) from the upstream side A is taken into the duct 9B through the air inlet 9D. This structure reduces the possibility of taking in dust having been blown off as a result of jet emission and drifting therearound through the air inlet 9D. Moreover, since the air flowing horizontally from the upstream side A is taken in through the air inlet 9D, this structure further reduces the possibility of taking in dust drifting in air.

In the present embodiment, dust on the medium 4 is blown off by a jet of air emitted through the nozzle opening 9A of the blowing device 9 at the upstream side A as viewed from the recording head 3. Therefore, good printing performance at the recording head 3 is realized. A more detailed explanation of this virtue of the embodiment is given below. When the medium 4, which is initially in the form of a roll, is unreeled, it is electrified (unreeling electrification). In addition, the medium 4 is electrified because of friction on the transportation path during transportation (frictional electrification). When the medium 4 in an electrified state arrives at the area of the heating device 7 made of a conductive material, apparent voltage level on the surface of the medium becomes 0 V. This is because electric charges having accumulated due to unreeling electrification and frictional electrification escape via the heating device 7 made of a conductive material (metal). Therefore, the medium 4 in such a charge-released state has weakened attraction for dust. For this reason, when air is blown to the predetermined area C, it is possible to effectively remove dust by taking advantage of the weakened attraction region, that is, the low voltage region of the medium 4 that was electrified due to unreeling electrification, etc.

Other Embodiments

Though an exemplary embodiment of the invention is explained above, the scope of the invention is not limited to the foregoing embodiment. For example, it is not always necessary that the air having been blown to the medium 4 should go in a direction away from the apparatus body 1 toward the upstream side A. Any structure that blows dust off the medium 4 on (over) the heating device 7 at the upstream side A falls within the technical scope of the invention.

In the foregoing embodiment, air flowing horizontally from the upstream side A is taken in through the air inlet 9D, which is located above the nozzle opening 9A. However, this structure is not always necessary. Though this structure is not always necessary, with the foregoing embodiment, it is possible to reduce the possibility of taking in dust having been blown off and up toward the upstream side A of the apparatus body 1 to the greatest possible extent.

In the foregoing embodiment, the recording apparatus I is explained as a so-called serial-type recording apparatus, in which the recording head 3 moves along the guide shaft 6 of the apparatus body 1. However, the recording apparatus I may be a so-called line-type recording apparatus, in which the recording head 3 is fixed to the apparatus body 1 and which printing is performed by moving the medium 4 only.

In the foregoing embodiment, an ink-jet recording apparatus is taken as an example of a liquid ejecting apparatus. However, the scope of the invention is not limited thereto. The invention is directed to various kinds of liquid ejecting apparatuses. Needless to say, the invention may be applied to a liquid ejecting apparatus that ejects liquid other than ink. Some examples of the head of other liquid ejecting apparatuses are: various recording heads used in an image recording apparatus such as a printer or the like, a color material ejection head used in color filter production for a liquid crystal display device or the like, an electrode material ejection head used for electrode formation of an organic EL display device, an FED (field emission display) device, or the like, and a living organic material ejection head used for production of biochips.

What is claimed is:

1. An air jet emission method used in a liquid ejecting apparatus that performs predetermined printing by ejecting liquid droplets from a liquid ejecting head provided in an apparatus body onto a medium, the medium being fed into the apparatus body while being guided by a guide, the medium being transported from an upstream side, which is one side with respect to the apparatus body, toward a downstream side, which is an opposite side with respect to the apparatus body, comprising:

emitting a jet of air or gas onto a surface of the transported medium at a predetermined area including a region of contact with a heater, thereby blowing dust off the surface of the transported medium, the heater being provided in the guide in a location that is located upstream in the transport direction of the medium from the liquid ejecting head so as to apply heat to the transported medium, the heater being made of a conductive material, the air being emitted by a blower that is located upstream in the transport direction of the medium from the liquid ejecting head and is opposite the heater at the predetermined area.

2. A liquid ejecting apparatus, comprising:

a medium that is transported along a guide and is fed into an apparatus body while being guided by the guide through an opening formed at an upstream side, which is one side with respect to the apparatus body, and is outputted through an opening formed at a downstream side, which is an opposite side with respect to the apparatus body;

a liquid ejecting head that performs predetermined printing by ejecting liquid droplets onto the medium;

a heater that is provided in the guide and provided upstream of the liquid ejecting head in the transport direction of the medium, is made of a conductive material, and applies heat to the medium; and a blower that emits a jet of air or gas through a nozzle opening to a predetermined area of the medium fed into the apparatus body, thereby blowing dust off the area, the blower being located upstream in the transport direction of the medium from the liquid ejecting head and being opposite the heater at the predetermined area.

3. The liquid ejecting apparatus according to claim 2, wherein the blower is configured in such a way that the air or the gas having been blown to the surface of the medium through the nozzle opening will go in a direction away from the apparatus body.

4. The liquid ejecting apparatus according to claim 3, wherein an angle formed by a direction in which the jet of the air or the gas is emitted through the nozzle opening and a slope of a surface area of the medium exposed to the jet of the air or the gas emitted is an acute angle.

5. The liquid ejecting apparatus according to claim 2, wherein the nozzle opening is formed at tip of a linear portion that is formed by linearly reducing a depth of a duct of the blower; and wherein the nozzle opening is elongated in a direction orthogonal to a transportation direction of the medium.

6. The liquid ejecting apparatus according to claim 2, wherein an air inlet of the blower is located above the nozzle opening, and the air or the gas is supplied from the upstream side as viewed from the nozzle opening by being taken in in a direction that is orthogonal to a direction in which the jet of the air or the gas is emitted through the nozzle opening.

7. The liquid ejecting apparatus according to claim 2, wherein operation of each component provided inside the apparatus body is controlled by an external controller provided outside the apparatus body.

8. A liquid ejecting apparatus, comprising:

an apparatus body for transporting a medium along in a transport direction;

a liquid ejecting head for ejecting liquid droplets onto the medium;

a heater, located upstream of the liquid ejecting head in the transport direction of the medium, is made of a conductive material, and is configured to apply heat to the medium; and a blower for emitting a jet of air or gas to a predetermined area of the medium fed along the apparatus body to blow dust off the area, the blower being located upstream of the liquid ejecting head in the transport direction of the medium and being opposite the heater at the predetermined area.

* * * * *